US009999792B2

(12) United States Patent
Bodemann et al.

(10) Patent No.: US 9,999,792 B2
(45) Date of Patent: Jun. 19, 2018

(54) WET PIPE FIRE PROTECTION SPRINKLER SYSTEM DUAL AIR VENT WITH WATER RETENTION AND RETURN

(71) Applicant: South-Tek Systems, LLC, Wilmington, NC (US)

(72) Inventors: Scott Christian Bodemann, Wilmington, NC (US); Timothy S. Bodemann, Wilmington, NC (US)

(73) Assignee: South-Tek Systems, LLC, Wilmington, NC (US)

( * ) Notice: Subject to any disclaimer, the term of this patent is extended or adjusted under 35 U.S.C. 154(b) by 0 days. days.

(21) Appl. No.: 15/254,487

(22) Filed: Sep. 1, 2016

(65) Prior Publication Data

US 2018/0056102 A1 Mar. 1, 2018

(51) Int. Cl.
*A62C 35/68* (2006.01)
*A62C 35/60* (2006.01)

(52) U.S. Cl.
CPC ..... *A62C 35/68* (2013.01); *A62C 35/60* (2013.01)

(58) Field of Classification Search
CPC ..... A62C 35/60; A62C 35/68; A62C 35/58; F16K 24/02; F16K 24/06
USPC ..... 169/16–18, 46; 137/197, 199, 202
See application file for complete search history.

(56) References Cited

U.S. PATENT DOCUMENTS 2,322,910 A * 6/1943 Adney ..... F04D 9/001 137/202
3,473,612 A * 10/1969 Poitras ..... A62C 35/605 169/11
5,154,232 A * 10/1992 McHugh ..... A62C 35/68 169/16
5,234,013 A * 8/1993 Roetker ..... B60K 15/03519 137/202
5,244,351 A * 9/1993 Arnette ..... F04D 15/0218 137/202
5,435,335 A * 7/1995 Klop ..... B67D 7/365 137/202
6,119,785 A * 9/2000 Reise ..... A62C 35/68 169/16
6,206,057 B1 * 3/2001 Benjey ..... B60K 15/03519 137/202
8,636,023 B2 * 1/2014 Burkhart ..... A62C 35/60 137/202

(Continued)

*Primary Examiner* — Christopher Kim
(74) *Attorney, Agent, or Firm* — Coats & Bennett, PLLC

(57) ABSTRACT

A dual air vent allows air or gas to be vented from a wet pipe fire protection sprinkler system, but inhibits water from spilling out. A conventional first air vent valve is operative to vent air or gas as a pipe is filled with water, but not vent the water. However, it may discharge a small amount of water when the pipe fills and substantially all air or gas has been vented. The output of the first air vent valve is not released into the protected premises, but rather is routed to a reservoir having a second air vent. Air or gas is vented through the second air vent, but any water discharged by the first air vent valve is retained in the reservoir. The reservoir is connected to the pipe by a one-way valve which allows air flow in either direction, and allows water flow from the reservoir to the pipe, but blocks water flow from the pipe to the reservoir. When the pipe is again drained, water retained in the reservoir is allowed to flow into the pipe, where it is also drained.

15 Claims, 7 Drawing Sheets

(56) References Cited

U.S. PATENT DOCUMENTS

| | | | | |
|---|---|---|---|---|
| 2015/0083441 | A1* | 3/2015 | Kochelek | A62C 37/00<br>169/16 |
| 2015/0151151 | A1* | 6/2015 | Bodemann | A62C 35/68<br>169/16 |

* cited by examiner

WET PIPE FIRE PROTECTION SPRINKLER SYSTEM DUAL AIR VENT WITH WATER RETENTION AND RETURN

FIELD OF INVENTION

The present invention relates generally to fire protection sprinkler systems, and in particular to a dual air vent for wet pipe systems with a water retention and return feature.

BACKGROUND

Fire sprinkler systems are a well-known type of active fire suppression system. Sprinklers are installed in all types of buildings, commercial and residential, and are generally required by fire and building codes for buildings open to the public. Typical sprinkler systems comprise a network of pipes, usually located at ceiling level, that are connected to a reliable water source. Sprinkler heads are disposed along the pipes at regular intervals. Each sprinkler head includes a fusible element, such as a frangible glass bulb, that is heat-sensitive and designed to fail at a predetermined temperature. Failure of the fusible element or glass bulb opens an orifice, allowing water to flow through the head, where it is directed by a deflector into a predetermined spray pattern. Sprinkler systems may suppress a fire, or inhibit its growth, thereby saving lives and limiting inventory loss and structural damage. Sprinkler specifications are published by the National Fire Protection Association (e.g., NFPA 13).

The fire protection sprinkler system is fed from a pump room or riser room. In a large building the fire protection sprinkler system consist of several "zones," each being fed from a separate riser in the pump room (i.e. a "zone" refers to the piping network tied to one particular riser). The riser contains the main isolation valve and other monitoring equipment (e.g., flow switches, alarm sensors, and the like). The riser is typically a 2, 3, 4, 6, or 8 inch diameter pipe coupled to the building's main water supply. In some cases, the water supply pressure may be increased with a booster pump (called the fire pump). The riser then progressively branches off into smaller branch lines. At the furthest point from the riser, typically at the end of each zone, there is an "inspector's test port," which is used for flow testing.

The most basic fire protection sprinkler system is a "wet pipe" system, wherein the sprinkler pipes are full of water under a predetermined "internal set point" pressure. If the water pressure decreases below the set point, valves are opened and the pump (if applicable) is activated, and water flows into the sprinkler pipes in an attempt to maintain the pressure. The set point pressure drops when water escapes the system, such as due to the opening of a sprinkler head in the event of a fire.

The pipes are periodically drained, and the piping network is inspected. Parts may be replaced, e.g., where signs of corrosion are observed, to install new functionality, or simply as part of a periodic replacement program. When the system is again filled with water, vents must be opened to allow air or other gas displaced by the water to exit (per 2016 NFPA 13 guidelines). These air vents are installed at high points in the piping network, and include a mechanism, such as a poppet or ball valve, which ideally allows air to escape but blocks the flow of water out of the vent. In practice, some small amount of is water inevitably discharged from the air vent before the water blocking mechanism can fully shut off the water flow. This spillage is at best a nuisance, and may present a hazard if the water were to fall onto, e.g., shopping center floors, computers, other electronic equipment, inventory, etc.

The Background section of this document is provided to place embodiments of the present invention in technological and operational context, to assist those of skill in the art in understanding their scope and utility. Approaches descried in the Background section could be pursued, but are not necessarily approaches that have been previously conceived or pursued. Unless explicitly identified as such, no statement herein is admitted to be prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the invention or to delineate the scope of the invention. The sole purpose of this summary is to present some concepts disclosed herein in a simplified form as a prelude to the more detailed description that is presented later.

According to one or more embodiments described and claimed herein, a dual air vent allows air or gas to be vented from a wet pipe fire protection sprinkler system, but inhibits water from spilling out. A conventional first air vent valve is operative to vent air or gas as a pipe is filled with water, but not vent the water. However, it may discharge a small amount of water when the pipe fills and substantially all air or gas has been vented. The output of the first air vent valve is not released into the protected premises, but rather is routed to a reservoir having a second air vent. Air or gas is vented through the second air vent, but any water discharged by the first air vent valve is retained in the reservoir. The reservoir is connected to the pipe by a one-way valve which allows air flow in either direction in the absence of water, and allows water flow from the reservoir to the pipe, but blocks water flow from the pipe to the reservoir. When the pipe is again drained and the water pressure is relieved from within the "zones", water retained in the reservoir is allowed to flow back into the pipe, where it is also drained.

One embodiment relates to a dual air vent operative to vent air or gas, but not water, from a wet pipe fire protection sprinkler system. The dual air vent includes a first air vent valve connected to a pipe of the sprinkler system. The first air vent valve includes a water blocking mechanism operative to vent air or gas but substantially no water from the pipe. The dual air vent also includes a reservoir, including a second air vent, connected to the pipe of the sprinkler system by a one-way valve. The one-way valve is operative to allow water to flow from the reservoir into the pipe but block water flow from the pipe to the reservoir. The reservoir is connected to an output of the first air vent valve in fluid flow relationship, such that air or gas, and any water discharged by the first air vent valve, enter the reservoir. Air or gas entering the reservoir from the first air vent valve is discharged from the reservoir via the second air vent, and water entering the reservoir from the first air vent valve is retained in the reservoir. When the pipe is drained, water retained in the reservoir flows via the one-way valve into the pipe.

Another embodiment relates to a method of operating a wet pipe fire protection system. The system includes at least one dual air vent comprising a first air vent valve connected to a pipe of the sprinkler system, the first air vent valve including a water blocking mechanism operative to vent air or gas but substantially no water from the pipe. The dual air vent also comprises a reservoir including a second air vent connected to the pipe of the sprinkler system by a one-way valve operative to allow water to flow from the reservoir into the pipe but block water flow from the pipe to the reservoir. The reservoir is connected to an output of the first air vent valve in fluid flow relationship. A pipe of the wet pipe fire protection system is filled with water. Air or gas, displaced by the water, is vented from the pipe via the first air vent valve, reservoir, and second air vent. Water is prevented from flowing directly from the pipe into the reservoir. Any water discharged by the first air vent valve as the pipe completely fills with water, is retained in the reservoir. Some time later, water is drained from the pipe of the wet pipe fire protection system, typically during annual maintenance of the fire protection system. Water retained in the reservoir is allowed to flow into the pipe to be drained.

BRIEF DESCRIPTION OF THE DRAWINGS

The present invention will now be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. Like numbers refer to like elements throughout.

DETAILED DESCRIPTION

For simplicity and illustrative purposes, the present invention is described by referring mainly to an exemplary embodiment thereof. In the following description, numerous specific details are set forth in order to provide a thorough understanding of the present invention. However, it will be readily apparent to one of ordinary skill in the art that the present invention may be practiced without limitation to these specific details. In this description, well known methods and structures have not been described in detail so as not to unnecessarily obscure the present invention.

Figure 1:
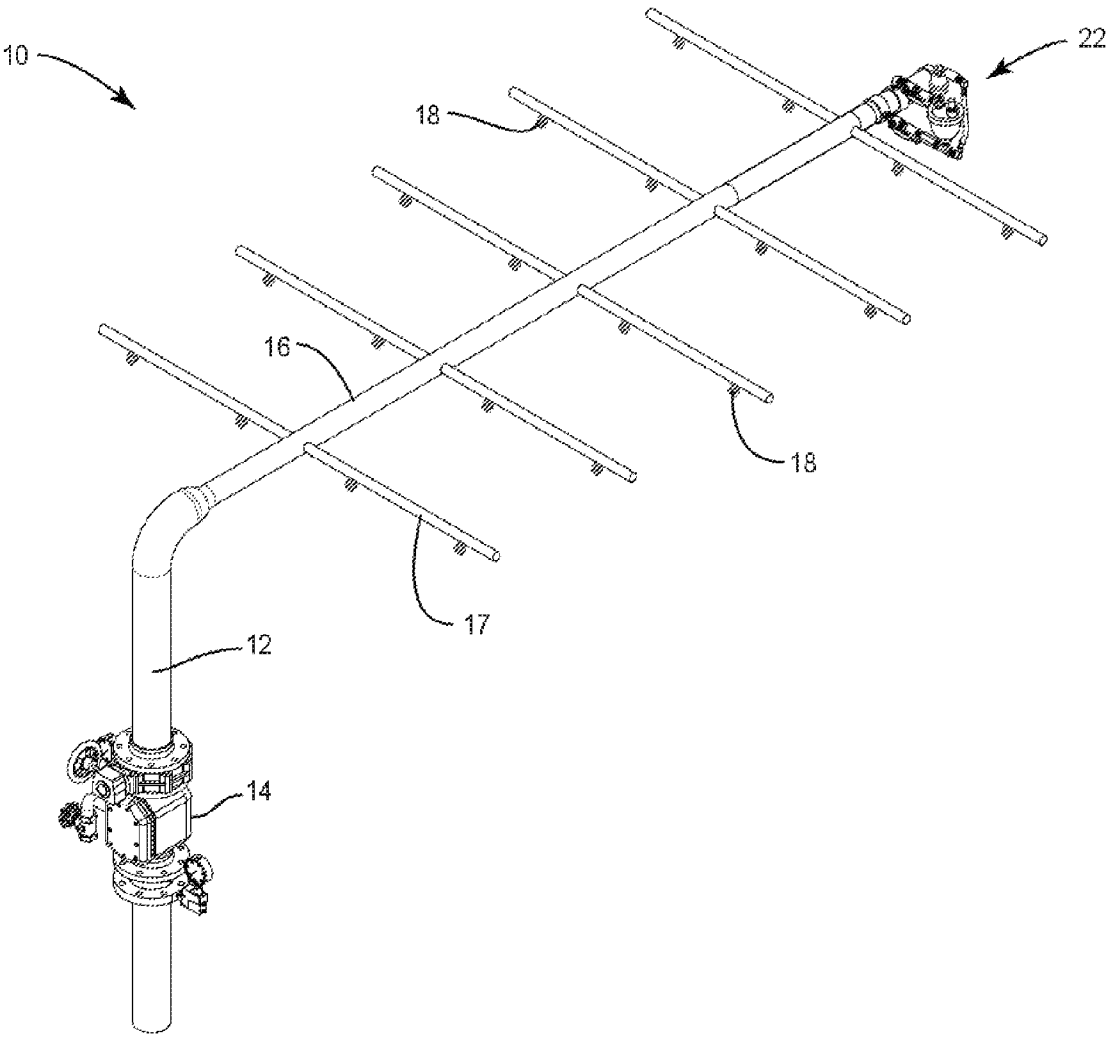
FIG. 1 is a perspective view of one section of a wet pipe fire protection sprinkler system.

FIG. 1 depicts a representative wet pipe fire protection sprinkler system 10, according to one embodiment of the present invention. Water from a reliable source, such as a city main, a water tank, or the like enters a building in a riser 12. A pump or valve 14 controls the flow of water into the fire protection sprinkler system 10, and once full, maintains the water under pressure. A pipe 16 for a particular zone of the building branches off from the riser 12. Smaller cross-pipes 17 branch from the zone pipe 16 at regular intervals, and generally cover the premises to be protected. Sprinkler heads 18 are disposed at regular intervals along the cross-pipes 17. In any given application, numerous risers 12, and multiple branch lines 16 per riser, may be present and distributed throughout the building.

Branch lines 16 should not be installed perfectly horizontally, but rather to have a defined slope toward one or more drains (not shown). At one or more high points in each branch line 16 a dual air vent 22 allows air, or other gas such as nitrogen, in the pipes 16 to escape, while completely preventing any spillage of water. As explained more fully herein, the dual air valve 22 comprises an air vent valve assembly 20 connected to a water retention and return assembly 50 by a hose 54.

Figure 2:
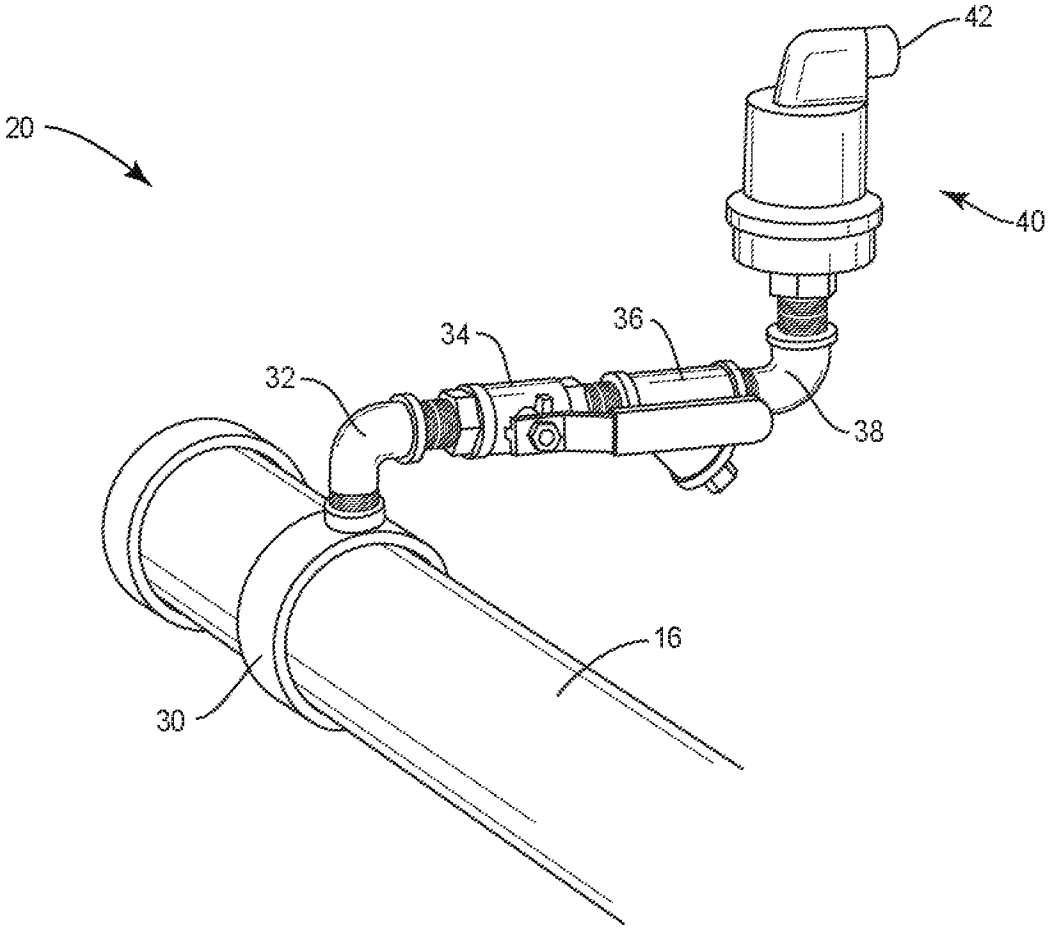
FIG. 2 (PRIOR ART)
FIG. 2 is a perspective view of a prior art air vent valve assembly.

FIG. 2 depicts a conventional air vent valve assembly 20. The air vent valve assembly 20 attaches to the upper side of a pipe 16, such as by a ½ inch NPT outlet coupling, and is held in place with a collar 30. Air or other gas displaced by water exits the pipe 16 as the pipe 16 fills, and eventually also water, passing through (in this particular configuration) a first elbow fitting 32, a manual valve 34, a filter trap 36, a second elbow fitting 38, and into an air vent valve 40. The manual valve 34 is operative to shut off air/gas or water flow from the pipe 16 to the first air vent valve 40. The filter trap 64 is a "Y" connection which includes a screen or other filter element to catch any debris which may otherwise interfere with operation of the air vent valve 40. The screen may be removed, without disassembling the air vent valve assembly 20, to clean or replace the screen or filter element.

The air vent valve 40 includes a water blocking mechanism that allows air or gas to pass, but largely blocks the flow of water. This could, for example, comprise a membrane, a poppet valve, a ball that seats against a pliant seal when moved by water, or the like. Such mechanisms are well known in the art. The air or gas exits a discharge port 42. Those of skill in the art will appreciate that the precise configuration of the air vent valve assembly 20 is representative only, and may vary in different installations.

When substantially all of the air or other gas in the pipe 16 has exited, and the pipe 16 fills with water, the water will follow the air or other gas into the air vent valve assembly 20. The water flow will be terminated by the water blocking mechanism in the air vent valve 40, such as a poppet or ball valve. However, in practice, a small amount of water is likely to be discharged from the discharge port 42, before the water blocking mechanism has fully engaged. Although not usually voluminous, this water discharge may damage ceiling tiles, equipment, inventory, or the like, or may create a slip-and-fall hazard on some types of flooring, particularly where water is not expected to be encountered.

According to embodiments of the present invention, a dual air vent 22 is operative to retain water inadvertently discharged by a conventional air vent valve 40, and return it to the pipe 16 the next time the pipe 16 is drained.

Figure 3:
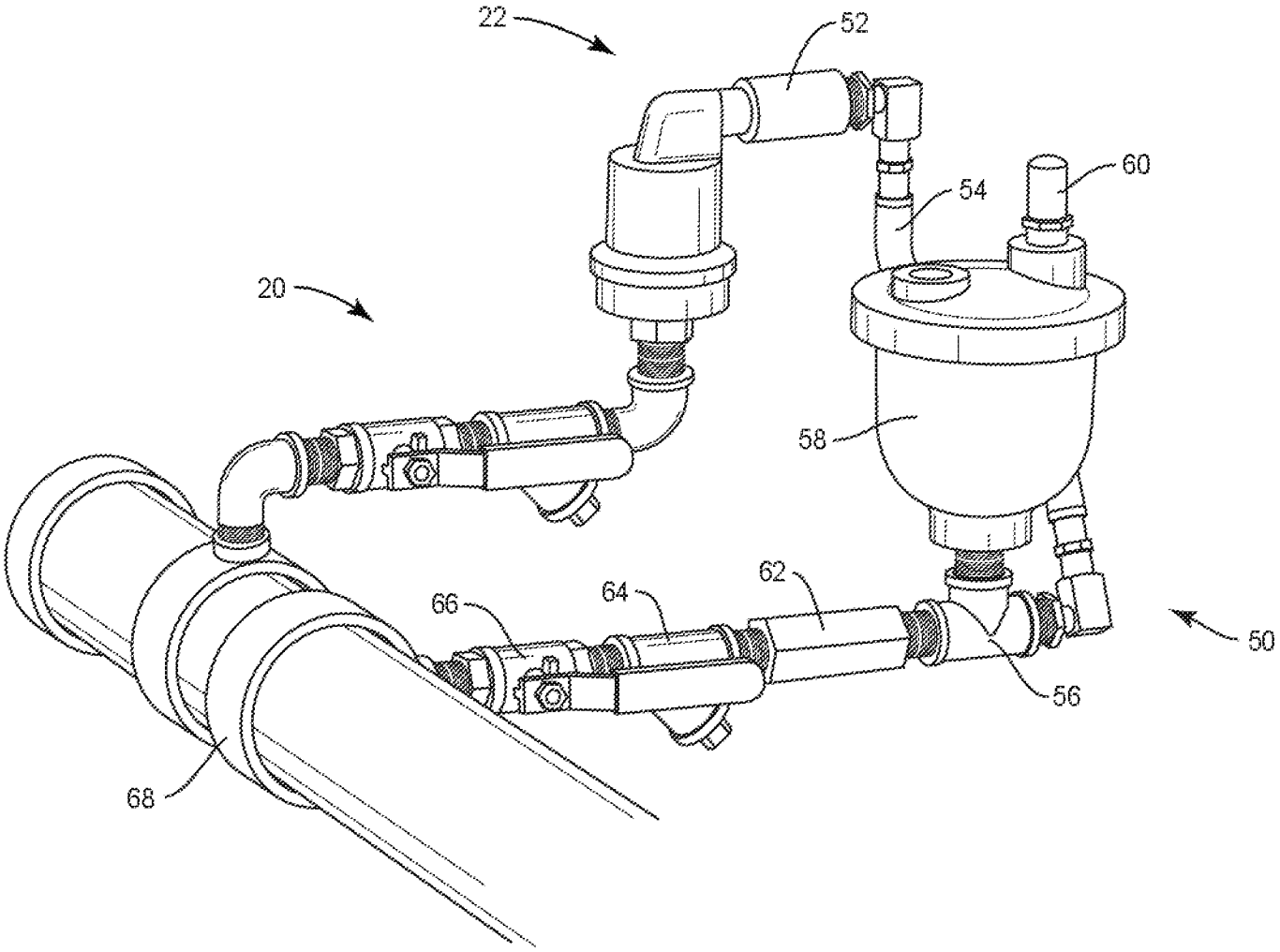
FIG. 3 is a first perspective view of a dual air vent.
Figure 4:
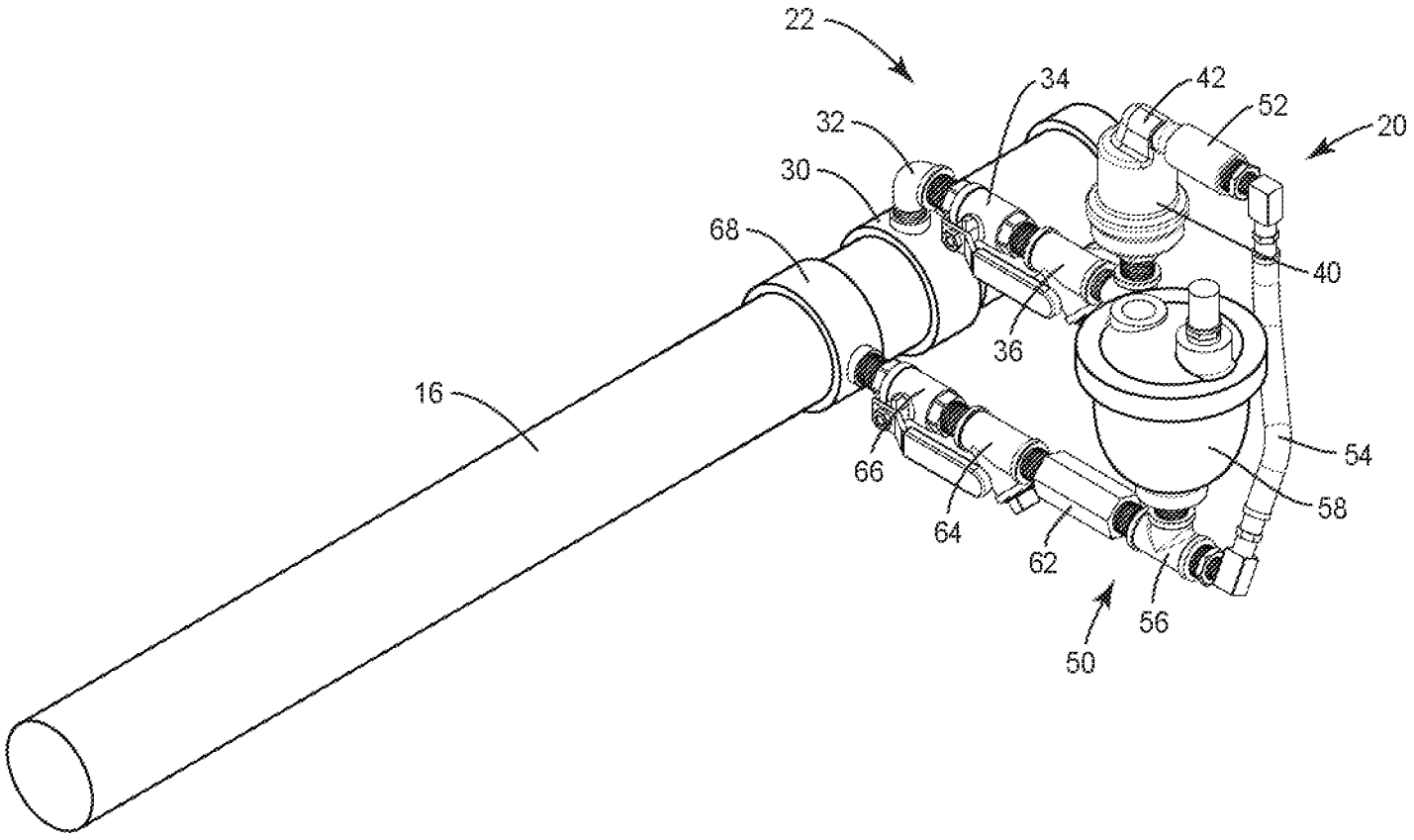
FIG. 4 is a second perspective view of a dual air vent.

FIGS. 3 and 4 depict views, from different perspectives, of the dual air vent 22, comprising an air vent valve assembly 20 and a water retention and return assembly 50, connected by a hose 54. The water retention and return assembly 50 attaches to the side of the pipe 16, such as by a ½ inch NPT outlet coupling, and is held in place with a collar 68. The water retention and return assembly collar 68 should be spaced apart from the air vent valve assembly collar 30, such as by at least 3.5 inches. The water retention and return assembly 50 comprises, in the embodiment depicted in FIGS. 3 and 4, a manual valve 66, a filter trap 64, a one-way valve 62, a T-coupling 56, and a reservoir 58 having an air vent 60. The manual valve 66 is operative to shut off air/gas or water flow in either direction between the pipe 16 and the reservoir 58. The filter trap 64 is a "Y" connection which includes a screen or filter, as described above for the filter trap 36. The one-way valve 62 allows air or gas to flow in either direction, and allows water to flow from the reservoir 58 to the pipe 16, but blocks water flow from the pipe 16 to the reservoir 58. The T-coupling 56 allows the free flow of air or gas and water in any direction, between any of its three openings.

The water retention and return assembly 50 connects to the air vent valve assembly 20 via a nozzle cover 52, operative to form a hermetic seal over the discharge port 42 of the air vent valve 40, and hose 54 connecting the nozzle cover 52 to the T-coupling 56 (note that in the view depicted in FIG. 3, the hose 54 runs behind the reservoir 58, and is partially obscured from view; FIG. 4 offers a fuller view of the hose 54).

Operation of the dual air vent 22 is described with reference to FIGS. 5A-5D, which are section drawings with air/gas and water flow indicators.

Figure 5A:
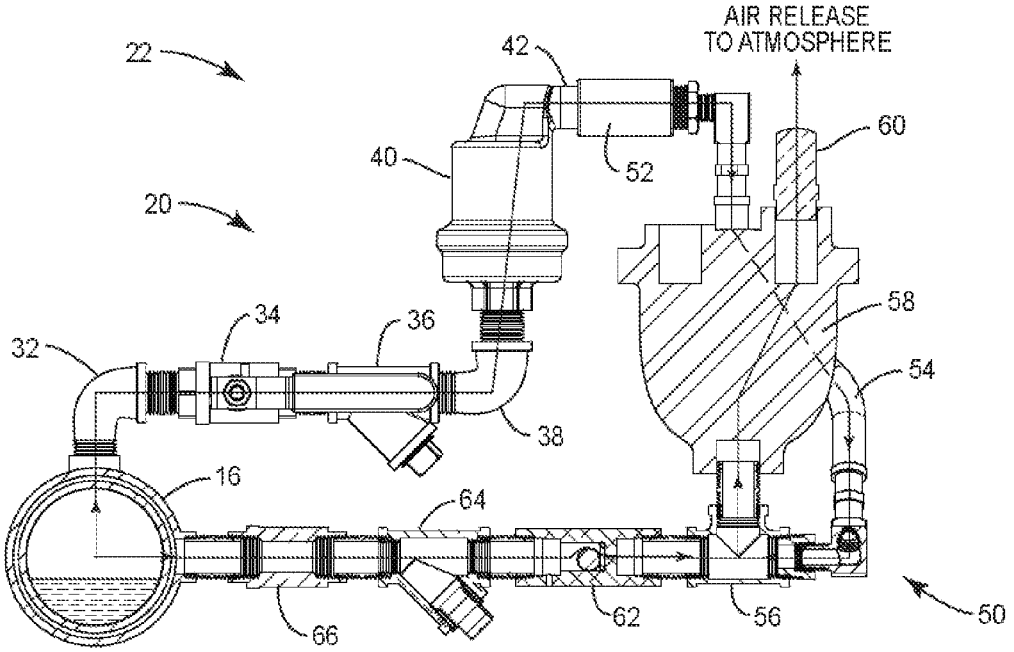
FIGS. 5A-5D are section views of the dual air vent at different stages in filling/draining the pipe.

FIG. 5A depicts the flow of air or other gas from the pipe 16 as it is displaced by water filling the pipe 16. The air or gas flows through the top opening of the pipe 16 and into the air vent valve assembly 20—through the elbow fitting 32, manual valve 34, filter trap 36, elbow fitting 38, and into the air vent valve 40. Rather than being discharged to the atmosphere through the discharge port 42, the air or gas is trapped by the nozzle cover 52, and flows to the water retention and return assembly 50. In particular, the air or gas flows through the hose 54 (note that the hose 54 is behind the reservoir 58 as depicted in FIGS. 5A-D), into the T-coupling 56, and then into the reservoir 58. The air or gas is then discharged via the air vent 60.

Simultaneously, air or gas also exits the side of the pipe 16 into the water retention and return assembly 50. In particular, the air or gas flows through the manual valve 66, filter trap 64, one-way valve 62, and into the T-coupling 56. The air or gas flowing through the water retention and return assembly 50 then joins the flow of air or gas from the air vent valve assembly 20 into the reservoir 58, and out of the air vent 60.

Figure 5B:
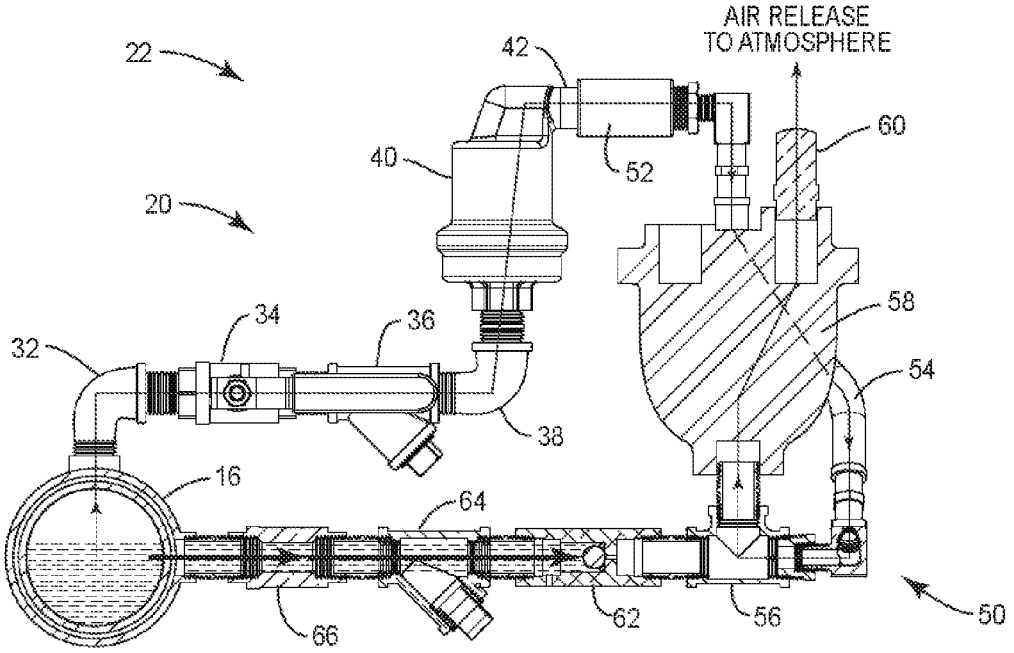

FIG. 5B depicts the operation of the dual air vent 22 when the water reaches and passes the level of the side opening in the pipe 16. Displaced air or gas continues to be discharged through the air vent valve assembly 20 and reservoir 58, as described above. Water now flows into the water retention and return assembly 50. The water flows through the manual valve 66 and filter trap 64, but is halted by the one-way valve 62. In one embodiment, the one-way valve 62 is a ball type check valve. In the check valve, air or gas may flow freely in either direction if no water is present, and water may flow from the reservoir 58 toward the pipe 16. However, water attempting to flow from the pipe 16 into the reservoir 58 will cause a ball to seat against a seal, such as a rubber o-ring, shutting off the flow of water. Air or gas continues to flow into the reservoir 58 from the air vent valve assembly 20, and is discharged via the discharge port 60.

Figure 5C:
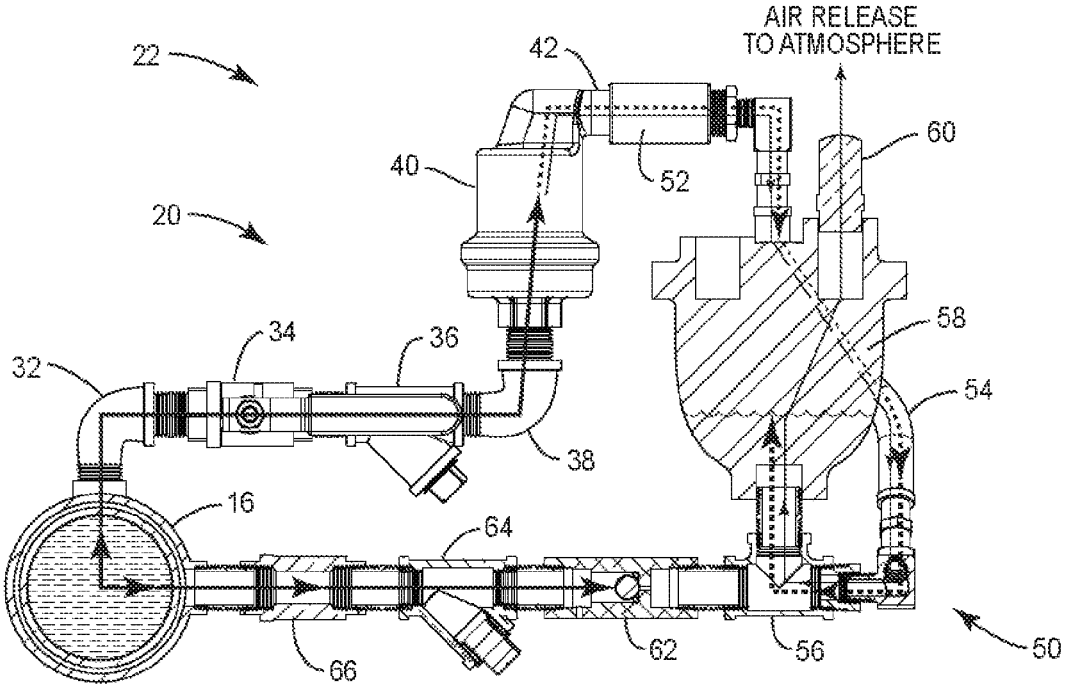

FIG. 5C depicts the pipe 16 completely filled with water. The water now flows through the opening in the top of the pipe 16 and through the air vent valve assembly 20, where it is halted by the water blocking mechanism in the air vent valve 40. Any collateral spillage from the air vent valve 40 flows, via gravity, through the hose 54 and into the reservoir 58, where it is retained, and does not spill out into the protected premises. Water flow is now blocked in both the air vent valve assembly 20 and the water retention and return assembly 50. Water flows, or is pumped, into the pipe 16 until a desired pressure is reached, and the wet pipe FPS system is then active to protect the premises from fire.

In one embodiment, the air vent 60 in the reservoir also includes a water blocking mechanism operative to allow air or gas but not water to be discharged (and is hence an air vent valve). In this embodiment, if the air vent valve 40 fails to block the water flow, water is not freely discharged from the pipe 16, but rather will fill the reservoir 58 and be stopped by the air vent valve 60. Note that this situation presents the same hazard as the air vent valve assembly 20 operating alone—some spillage of water is likely before the water blocking mechanism in the air vent valve 60 is able to fully block all water flow. However, in this scenario, the air vent valve 60 acts as a backup to a failed air vent valve 40, and a small spillage is preferable to the unfettered flow of water that would otherwise occur. Furthermore, this small spillage is the only indication to building maintenance personnel that the air vent valve 40 has failed.

Figure 5D:
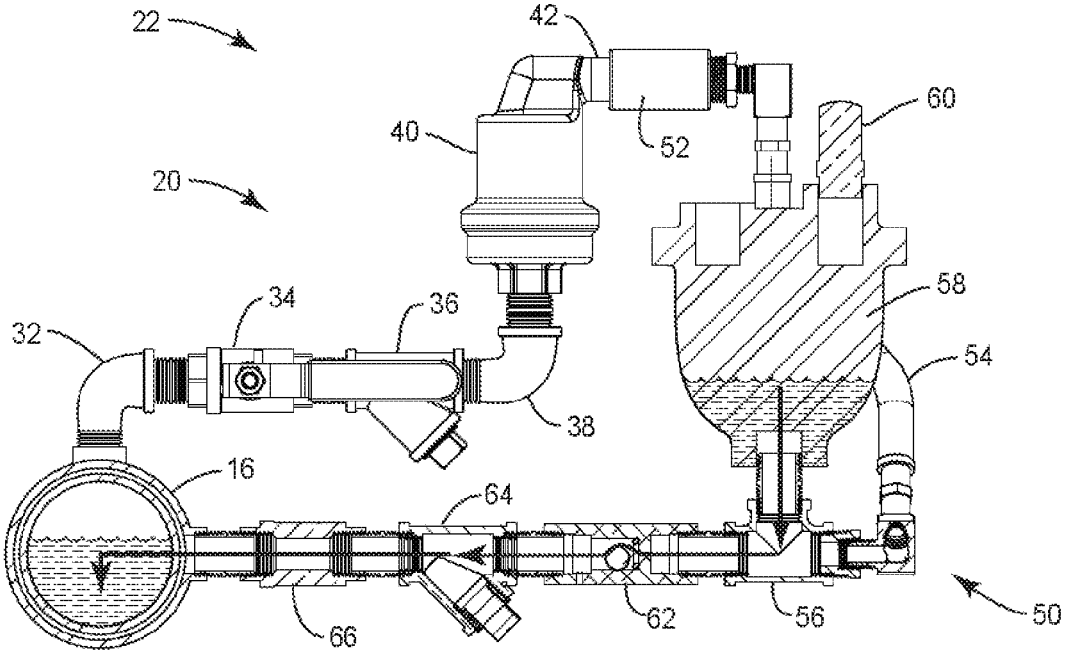

FIG. 5D depicts the operation of the dual air vent 22 when the wet pipe fire protection sprinkler system 10 is again drained for inspection and/or maintenance. Water drains (by gravity) from the air vent valve assembly 20 into the pipe 16. Water collected in the reservoir 58—whether from collateral spillage or complete failure of the air vent valve 40—also drains back into the pipe 16. In particular, the water drains from the reservoir 58 through the T-coupling 62, and through the one-way valve 62, which will allow water flow in this direction but not the opposite direction. The water flows through the filter trap 64 and manual valve 66, back into the pipe 16 to be drained.

Figure 6:
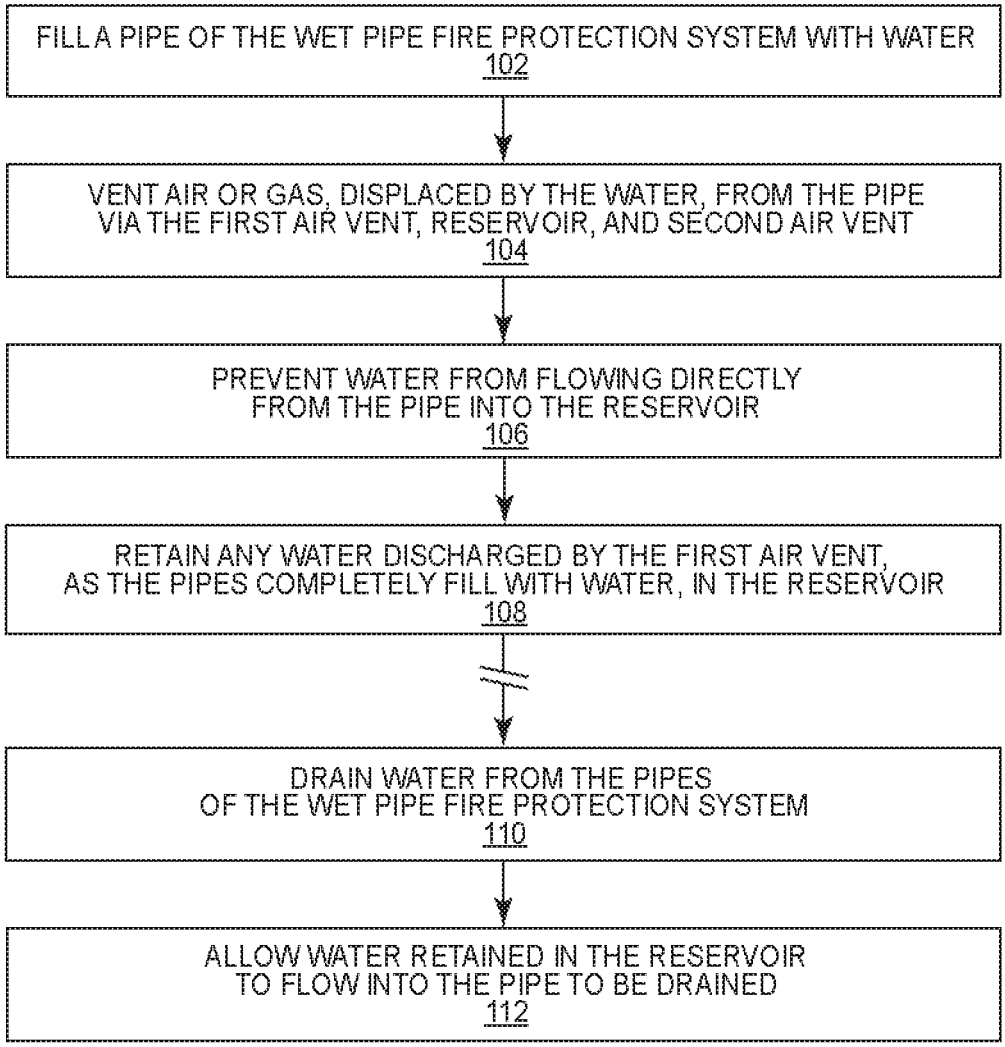
FIG. 6 is a flow diagram of a method of operating a wet pipe fire protection system.

FIG. 6 depicts a method 100 of operating a wet pipe fire protection sprinkler system 10 including at least one dual air vent 22. As described above, the dual air vent 22 comprises a first air vent valve 40 connected to a pipe 16 of the sprinkler system 10. The first air vent valve 40 includes a water blocking mechanism operative to vent air or gas but substantially no water from the pipe 16. The dual air vent 22 also includes a reservoir 58 including a second air vent 60 connected to the pipe 16 of the sprinkler system 10 by a one-way valve 62 operative to allow water to flow from the reservoir 58 into the pipe 16 but block water flow from the pipe 16 to the reservoir 58. The reservoir 58 is connected to an output of the first air vent valve 40 in fluid flow relationship.

According to the method 100, a pipe 16 of the wet pipe fire protection system 10 is filled with water (block 102). Air or gas displaced by the water is vented from the pipe 16 via the first air vent valve 40, reservoir 58, and second air vent 60 (block 104). Water is prevented from flowing directly from the pipe 16 into the reservoir 58, such as by a one-way valve 62 (block 106). Any water discharged by the first air vent valve 40 as the pipe 16 completely fills with water, is retained in the reservoir 58 (block 108). Some time later, as indicated by the broken control flow arrow, water is drained from the pipe 16 of the wet pipe fire protection system 10 (block 110). At this time, water retained in the reservoir 58 is allowed to flow into the pipe 16, such as via the one-way valve 62, to be drained (block 112).

As described above, the dual air vent 22 according to embodiments of the present invention comprises both an air vent valve assembly 20 and a water retention and return assembly 50, connected together in fluid flow relationship by a hose 54. In many exiting wet pipe fire protection sprinkler systems 10, an air vent valve arrangement similar to the air vent valve assembly 20 already exists. In these systems 10, a water retention and return assembly 50 may be installed in the pipe 16, and the T-connection 56 connected to the existing air vent valve by a hose 54, to create a dual air vent 22 operative to completely contain water as the system 10 is filled. In these cases, those of skill in the art may readily fashion a nozzle cover 52 operative to connect the hose 54 to a discharge port of the existing air vent valve.

In the above description, reference has been made to air or other gas vented from the pipe 16. Corrosion is a known problem in all types of fire protection sprinkler systems. In wet pipe systems 10, after all of the pipes 12, 16, 17 are filled with water, small pockets of air inevitably remain. This air includes oxygen, which will support oxidation—that is, rust—of the pipes 12, 16, 17. The oxygen also enables aerobic microscopic organisms to live in the water or at the air/water interface; these organisms give off waste products that cause or accelerate corrosion (known as Microbiologically Influenced Corrosion, or MIC). One known approach to inhibiting corrosion in wet pipe systems 10 is to displace atmospheric air in the pipes 12, 16, 17 with nitrogen gas prior to filling the pipes 12, 16, 17 with water. In this case, after the pipes 12, 16, 17 are filled with water, small pockets of gas will still remain; however, they will contain only inert nitrogen gas, and no oxygen. Hence neither rust nor MIC can occur. The dual air vent 22 according to embodiments of the present invention is operative to allow either air or nitrogen gas to exit the pipes 16 as they are filled with water, without the collateral release of any water into the protected premises.

Even in wet pipe systems 10 that do a nitrogen gas purge of the pipes 12, 16, 17 prior to filling them with water, oxygen may still be present in the system 10. Water usually contains dissolved oxygen—that is, O2 molecules, apart from the oxygen bound up in the H2O molecules forming the water itself. As one example, a test of local city water at 60 degrees F. in Charlotte, N.C. revealed an O2 content of 9.617 ppm (parts per million). Due to the partial pressure of gases, O2 from such water will outgas into the pockets of N2 within the pipes 12, 16, 17, providing enough O2 for the onset of detrimental corrosion. Accordingly, simply purging wet FPS pipes with N2 prior to charging the system may not provide an adequate long-term solution to corrosion.

Deoxygenating water—the process of reducing the number of free oxygen molecules dissolved in water—prior to charging a wet fire protection sprinkler system 10 is known. Water may be deoxygenated by exposure to low-O2-concentration gas and/or vacuum conditions to draw O2 and other residual free gasses out of the water, causing the dissolved O2 to "outgas" into the lower-concentration gas or vacuum. It is known to use N2 gas to deoxygenate water for wet fire protection sprinkler systems. For example, U.S. Patent Application Publication No. 2011/0226495 discloses a wet fire protection sprinkler system having a water reuse tank and in-line static mixer. The reuse tank is filled with sufficient fresh water to fill the fire protection sprinkler system pipe volume. This water is circulated from the tank through the in-line static mixer, with N2 gas being injected in the circulation line from an N2 generator. The water is circulated through the in-line static mixer until a desired level of deoxygenation is achieved, such as approximately 0.1 ppm (parts per million) of O2. As another example, U.S. Patent Application Publication No. 2015/0151151, incorporated herein by reference in its entirety, discloses the use of a Gas Transfer Membrane (GTM) device to dynamically deoxygenate water as it flows from a source, such as city water, into the fire protection sprinkler system pipes 12, 16, 17. For example, the water may be deoxygenated to 500 ppb (parts per billion) O2 or less. The dual air vent 22 according to embodiments of the present invention is operative to allow air or gas to exit a pipe 16, while preventing the spillage of either untreated or deoxygenated water.

Embodiments of the present invention cure a known deficiency in the prior art, that most air vent valves designed to vent air or gas but prevent the flow of water, in practice will discharge a small amount of water when water flow initially hits the valve. This discharge may range from a nuisance to an unacceptable risk to equipment or inventory, depending on the installation. Use of the dual air vent 22 as described and claimed herein eliminated all discharge of water during normal operation. Additionally, the dual air vent 22 provides a valuable "back-up" protection to stop the outflow of water in the event a first (or existing) air vent valve 40 fails. The dual air vent 22 comprises two sub-assemblies—an air vent valve assembly 20 and a water retention and return assembly 50, connected by a hose 54 and nozzle cover 52. Since most wet pipe fire protection systems 10 will already have some sort of arrangement performing the function of the air vent valve assembly 20, the dual air vent 22 can be added to these systems 10 by simply installing the water retention and return assembly 50 to the pipe 16, and connecting it to the existing air vent with a hose 54. An appropriate nozzle cover 52 or the functional equivalent may easily be fashioned, by those of skill in the art, to attach the hose 54 to an existing air vent valve 40. Accordingly, the discharge of water, upon filling wet pipe fire protection systems 10, may be eliminated, in both new and existing installations.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A dual air vent operative to vent air or gas, but not water, from a wet pipe fire protection sprinkler system, comprising:

a first air vent valve connected to a pipe of the sprinkler system, the first air vent valve including a water blocking mechanism operative to vent air or gas but substantially no water from the pipe; and a reservoir including a second air vent connected to the pipe of the sprinkler system by a one-way valve operative to allow water to flow from the reservoir into the pipe but block water flow from the pipe to the reservoir;

wherein the reservoir is connected to an output of the first air vent valve in fluid flow relationship, such that air or gas, and any water discharged by the first air vent valve, enter the reservoir; and wherein air or gas entering the reservoir from the first air vent valve is discharged from the reservoir via the second air vent, and water entering the reservoir from the first air vent valve is retained in the reservoir; and wherein when the pipe is drained, water retained in the reservoir flows via the one-way valve into the pipe.

2. The dual air vent of claim 1 wherein the first air vent is connected to the pipe at the top of the pipe.

3. The dual air vent of claim 1 wherein the second air vent is connected to the pipe at the side of the pipe.

4. The dual air vent of claim 1 wherein the reservoir is disposed below the first air vent such that water flows from the first air vent to the reservoir by gravity.

5. The dual air vent of claim 1 wherein the second air vent is operative to allow air or gas but not water to exit the reservoir.

6. The dual air vent of claim 1 wherein a manual valve is interposed between the pipe and the first air vent.

7. The dual air vent of claim 1 wherein a filter trap is interposed between the pipe and the first air vent.

8. The dual air vent of claim 1 wherein a manual valve is interposed between the pipe and the second air vent.

9. The dual air vent of claim 1 wherein a filter trap is interposed between the pipe and the second air vent.

10. The dual air vent of claim 1 wherein the air or gas discharged by the first air vent is nitrogen gas.

11. The dual air vent of claim 1 wherein the water filling the pipe is deoxygenated water having an O2 concentration of 500 ppb or less.

12. A method of operating a wet pipe fire protection system including at least one dual air vent comprising a first air vent valve connected to a pipe of the sprinkler system, the first air vent valve including a water blocking mechanism operative to vent air or gas but substantially no water from the pipe, and a reservoir including a second air vent connected to the pipe of the sprinkler system by a one-way valve operative to allow water to flow from the reservoir into the pipe but block water flow from the pipe to the reservoir, the reservoir connected to an output of the first air vent valve in fluid flow relationship, the method comprising:

filling a pipe of the wet pipe fire protection system with water;

venting air or gas, displaced by the water, from the pipe via the first air vent valve, reservoir, and second air vent;

preventing water from flowing directly from the pipe into the reservoir;

retaining water discharged by the first air vent valve in the reservoir;

draining water from the pipe of the wet pipe fire protection system; and allowing water retained in the reservoir to flow into the pipe to be drained.

13. The method of claim 12 further comprising:

prior to filling the pipe with water, injecting nitrogen gas into the pipe and venting air displaced by the nitrogen gas via the first air vent valve, reservoir, and second air vent.

14. The method of claim 12 further comprising:

prior to filling the pipe with water, deoxygenating the water to an O2 concentration of 500 ppb or less.

15. The method of claim 14 wherein deoxygenating the water comprises interposing a Gas Transfer Membrane (GTM) deoxygenating device between a building water supply and the wet fire protection system pipes and supplying nitrogen gas to the GTM device.

* * * * *